US007223015B2

(12) United States Patent
Steffens

(10) Patent No.: US 7,223,015 B2
(45) Date of Patent: May 29, 2007

(54) TAMPER-EVIDENT CLOSURE

(75) Inventor: Jeffrey E. Steffens, Edison, NJ (US)

(73) Assignee: Superior Bag Manufacturing Corporation, Rahway, NJ (US)

( * ) Notice: Subject to any disclaimer, the term of this patent is extended or adjusted under 35 U.S.C. 154(b) by 204 days.

(21) Appl. No.: 10/603,345

(22) Filed: Jun. 25, 2003

(65) Prior Publication Data

US 2004/0264813 A1 Dec. 30, 2004

(51) Int. Cl.
*B65D 33/14* (2006.01)
*B32B 9/00* (2006.01)
*B32B 3/00* (2006.01)

(52) U.S. Cl. ..... 383/5; 428/42.1; 428/202; 428/915; 428/916

(58) Field of Classification Search ..... 383/5, 383/95; 428/915–916, 40.1, 42.1, 201–203
See application file for complete search history.

(56) References Cited

U.S. PATENT DOCUMENTS 4,149,738 A 4/1979 Illos et al.
4,184,701 A * 1/1980 Franklin et al. ..... 283/67
4,603,785 A 8/1986 Gach
4,709,397 A 11/1987 Voshall et al.
4,834,552 A 5/1989 Makowka
4,876,123 A * 10/1989 Rivera et al. ..... 428/34.2
4,898,412 A 2/1990 Wenk
4,923,309 A 5/1990 VanErden
5,077,001 A 12/1991 Makowka
5,123,686 A 6/1992 Wenk
5,391,136 A 2/1995 Makowka
5,405,197 A 4/1995 Makowka
5,524,945 A 6/1996 Georgopoulos et al.
5,584,580 A 12/1996 Vetter
5,629,093 A * 5/1997 Bischof et al. ..... 428/411.1

(Continued)

FOREIGN PATENT DOCUMENTS

EP 0 341 699 A1 11/1989

*Primary Examiner*—Jes F. Pascua
(74) *Attorney, Agent, or Firm*—Lerner, David, Littenberg, Krumholz & Mentlik, LLP

(57) ABSTRACT

A security bag includes a tamper-evident closure which provides a visual indication if the closure is opened. The closure includes an ink layer deposited on one wall of the security bag or on a flexible strip secured to one wall of the security bag, and an adhesive layer in overlying relationship with the ink layer for sealing the bag closed. The ink layer includes a release material deposited in a predetermined pattern, and a layer of a solid ink applied over the release material so that the predetermined pattern of the release material is not visible in the closure. The solid ink layer includes void spaces arranged in a predetermined pattern. Preferably, the pattern of the void spaces is out of registry with the pattern of the release material so that the void spaces and release material overlap to varying degrees in the closure. If the closure is forced open, the solid ink will delaminate from the surface on which it is printed, revealing in the closure the predetermined pattern of the release material. Because the release material and the void spaces overlap by varying degrees, it is difficult to use a quick-drying marker or other coloring technique to fill in the pattern created by the release material so as to conceal an unauthorized opening of the bag.

17 Claims, 6 Drawing Sheets

U.S. PATENT DOCUMENTS 5,631,068 A 5/1997 Smith
5,633,058 A * 5/1997 Hoffer et al. ..... 428/40.1
5,641,318 A 6/1997 Vetter
5,658,411 A * 8/1997 Faykish ..... 156/233
5,683,774 A * 11/1997 Faykish et al. ..... 428/40.1
5,862,101 A * 1/1999 Haas et al. ..... 368/327
6,033,762 A 3/2000 Decker
6,048,098 A 4/2000 Vetter
6,096,387 A 8/2000 Decker
6,149,203 A 11/2000 Hanlon
6,196,716 B1 3/2001 Geyer
6,267,505 B1 7/2001 Henson
6,270,256 B1 8/2001 Todman
6,375,069 B1 4/2002 Smith
6,395,376 B1 * 5/2002 Cooley ..... 428/195.1
6,413,605 B1 * 7/2002 Hoffer ..... 428/40.1
2003/0056891 A1 3/2003 Schroder et al.

* cited by examiner

TAMPER-EVIDENT CLOSURE

BACKGROUND OF THE INVENTION

The present invention relates generally to tamper-evident closures and, more particularly, to tamper-evident closures which make it more difficult to conceal the fact that a closure has been opened at extreme temperatures.

Tamper-evident closures have been around for many years and are available in many forms. One such closure is a tamper-evident tape or label which is used to seal conventional boxes, bags and other containers. Another such closure is that found on specially designed security pouches or envelopes, such as those used in banking and other industries. Tamper-evident closures are intended to protect the contents of a package by indicating whether an attempt has been made to open the package and access its contents.

One well-known form of security package is a plastic bag, pouch or envelope (referred to herein as a bag) commonly utilized to transport money, checks, bonds, stocks, food stamps, medical specimens, jewelry and other valuable articles. These bags are typically formed from a plastic film folded in the middle and sealed along opposed side edges to form an enclosure having an open end for inserting articles into the bag. To close the bag, a peel-back strip covering one surface of a pressure-sensitive adhesive is removed, and the exposed adhesive is then pressed against the opposite side of the bag. If an attempt is made to open a bag of this type along the adhesive seal, the pressure-sensitive adhesive or other parts of the bag will distort, providing an indication of the attempted opening. Variants of this type of security bag may include layers of ink, release materials and other materials intended to enhance the ability of the bag to quickly and accurately reveal attempts to open the adhesive seal.

One problem that has arisen with respect to the adhesive materials used to seal these security bags is that the adhesive seals may be secretly opened by subjecting the seals to extreme temperatures. For example, the temperature of the sealed region can be lowered, such as by spraying Freon or another refrigerant onto the sealed region or applying dry ice to the sealed region. Lowering the temperature of the adhesive below its transition temperature causes the adhesive to become brittle and lose its adhesive qualities. The bag can then be opened and its contents accessed or removed. When the adhesive warms back to room temperature, it regains its adhesive properties, and the bag may be resealed without any evidence of tampering. Alternatively, the sealed region may be warmed, such as with a hand-held hair dryer, to soften the adhesive and lessen its adhesive properties. The bag may then be opened and the contents of the bag may be removed. While warm, the adhesive seal may be reclosed. The seal will regain its strength as the adhesive cools and regains its adhesive properties.

In one widely used security bag of this type, the tamper-evident closure includes a transparent or partially transparent substrate, a release material printed in a predetermined pattern on the substrate, and a solid ink printed in a uniform coating over the substrate and release material. A pressure-sensitive adhesive seals the bag in a closed condition. Any attempt to open the bag after it has been sealed will cause the portions of the ink layer overlying the release material to pull away from the substrate, revealing the predetermined pattern in which the release material has been deposited.

When thieves subject the foregoing security bag to refrigerant tampering, they are still confronted with the pattern revealed in the ink layer when the bag is opened. In order to hide this evidence of tampering, the thieves have developed a procedure in which they use a quick-drying ink marker of a color similar to the printed ink to fill in the pattern in the ink layer. Upon resealing of the bag, it is difficult to see that the pattern has been filled in, and the bag appears as if it has not been tampered with.

Although attempts have been made to address the problem of refrigerant tampering, these attempts have not been entirely successful. One reason for this lack of success is that the tamper-evident closures developed to address this problem often have complex structures which are both difficult and costly to manufacture. Another reason for this lack of success is that the evidence of tampering provided by these closures oftentimes is difficult to see without close inspection. Therefore, in environments such as the counting rooms of banks where these security bags are processed in large volumes, evidence that a bag has been tampered with is often overlooked.

There therefore exists a need for a tamper-evident security bag which may be manufactured easily and at low cost, and which provides quick and reliable evidence of tampering, even where a refrigerant or heat source has been used in the tampering process.

SUMMARY OF THE INVENTION

The present invention addresses these needs.

One aspect of the present invention provides a tamper-indicating bag. In one embodiment, the bag includes first and second walls joined together along spaced joining lines to form an enclosure having an open end. A tamper-evident indicator is positioned so as to be disposed between the first wall and the second wall in a sealed condition of the enclosure. The indicator includes a release material disposed in a predetermined pattern, and a layer of ink disposed in overlying relationship to the release material, the ink layer including a plurality of void spaces arranged in a selected pattern. A layer of adhesive is adapted to secure the first wall to the second wall in the sealed condition of the enclosure so that the ink layer is disposed between the first wall and the adhesive layer. The ink layer has a greater adhesion to the second wall than to the first wall in regions overlying the release material, and has a lower adhesion to the second wall than to the first wall in regions not overlying the release material so that, upon separation of the first wall from the second wall, portions of the ink layer will separate from the first wall while a remainder of the ink layer will not separate from the first wall, whereby the predetermined pattern will be visible in the indicator.

In another embodiment, the bag includes first and second walls joined together along spaced joining lines to form an enclosure having an open end. A tape secured to the first wall is spaced from the second wall in an open condition of the enclosure and is secured to the second wall in a sealed condition of the enclosure. The tape includes an elongated flexible strip, a release material disposed in a predetermined pattern on the strip, and a layer of ink disposed on the strip in overlying relationship to the release material, the ink layer including a plurality of void spaces arranged in a selected pattern. A layer of adhesive is adapted to secure the tape to the second wall in the sealed condition of the enclosure so that the ink layer is disposed between the strip and the adhesive layer. The ink layer has a greater adhesion to the second wall than to the strip in regions overlying the release material, and has a lower adhesion to the second wall than to the strip in regions not overlying the release material so that, upon separation of the strip from the second wall, portions of the ink layer will separate from the strip while the remainder of the ink layer will not separate from the strip, whereby the predetermined pattern will be visible in the tape.

The predetermined pattern of the release material preferably is different from the selected pattern of the plurality of void spaces. The predetermined pattern of the release material may at least partially overlap with the selected pattern of the plurality of void spaces. Moreover, the predetermined pattern of the release material may be out of registry with the selected pattern of the plurality of void spaces.

In embodiments employing an elongated flexible strip, the strip preferably is at least partially transparent. In such embodiments, the tape may have a first visual appearance in an initial sealed condition of the enclosure, and a visual appearance upon separation of the tape from the second wall which is different from the first visual appearance. A preprinted graphic on one of the first and second walls may have an appearance which is the same as the first visual appearance of the tape.

In other embodiments not employing an elongated flexible strip, the first wall preferably is at least partially transparent in a region which overlies the indicator in the sealed condition of the enclosure. In such embodiments, the tamper-evident indicator may have a first visual appearance in an initial sealed condition of the enclosure, and a visual appearance upon separation of the first wall from the second wall which is different from the first visual appearance. A preprinted graphic on one of the first and second walls may have an appearance which is the same as the first visual appearance of the tamper-evident indicator.

Another aspect of the present invention provides a tamper-indicating tape for providing a closure seal for a container. The tape includes an elongated, flexible strip having first and second sides. A layer of a release material is disposed in a predetermined pattern on the first side of the strip. A layer of ink is disposed on the first side of the strip in overlying relationship to the release material, the ink layer including a plurality of void spaces arranged in a selected pattern. A layer of adhesive overlies the ink layer. The ink layer has a greater adhesion to the adhesive layer than to the strip in regions overlying the release material, and has a lower adhesion to the adhesive layer than to the strip in regions not overlying the release material so that, upon separation of the tape from the container, portions of the ink layer will separate from the strip while the remainder of the ink layer will not separate from the strip, whereby the predetermined pattern will be visible in the tape.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
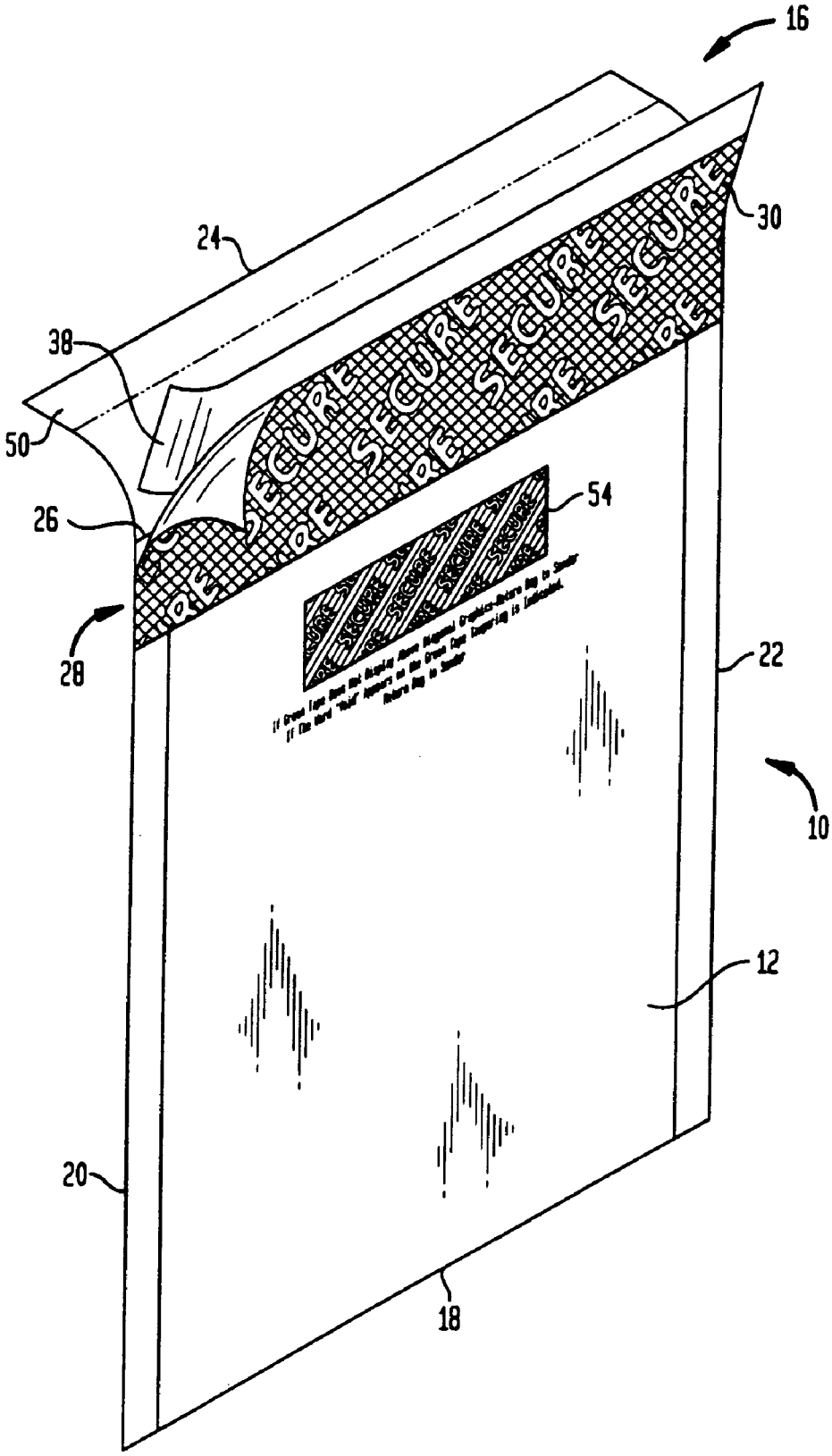
FIG. 1 is a front perspective view of a tamper-evident security bag in accordance with the present invention.

One embodiment of a security bag 10 incorporating the tamper-evident features of the present invention is illustrated in FIGS. 1–4. Bag 10 includes a front wall 12 and a rear wall 14 joined together at the bottom and side edges to form an enclosure having an opening 16 at one end thereof. Bag 10 may be formed from a single strip of flexible thermoplastic sheet material, such as polyethylene or polypropylene, folded laterally along fold line 18 to form front wall 12 and rear wall 14 which are then joined to one another along side edges 20 and 22 by heat welding, ultrasonic welding or other known sealing techniques. Front wall 12 and rear wall 14 are joined together such that the free end 24 of rear wall 14 extends further than the free end 26 of front wall 12. A seal 28 is provided to close opening 16 and to provide visual evidence of any forced opening of the seal. The extra length of rear wall 14 may include a detachable identification strip 50 which may be removed from the bag and used as a receipt.

Seal 28 includes a tape 30 secured along its bottom edge to the outer surface of front wall 12 adjacent its free end 26. As best seen in FIGS. 5A–5D and 6, tape 30 has a multilayer structure including a plastic strip 32, an ink layer 34 applied to the inner surface of the strip, a layer of adhesive 36 applied over the ink layer, and a peel-back strip 38 covering the adhesive layer. Each of these layers will be described in detail below.

Figure 5A:
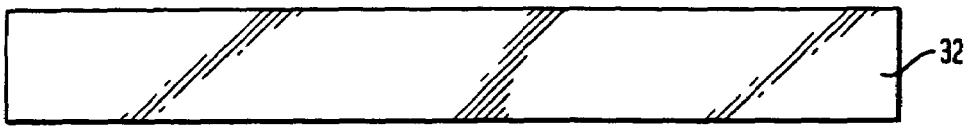
FIGS. 5A–5D are top views of a tape which may be used in the formation of the tamper-evident security bag of FIG. 1.
Figure 5B:
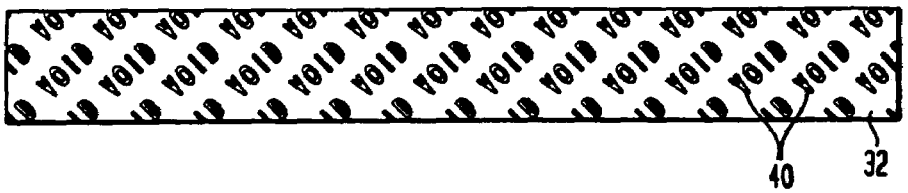
Figure 5C:
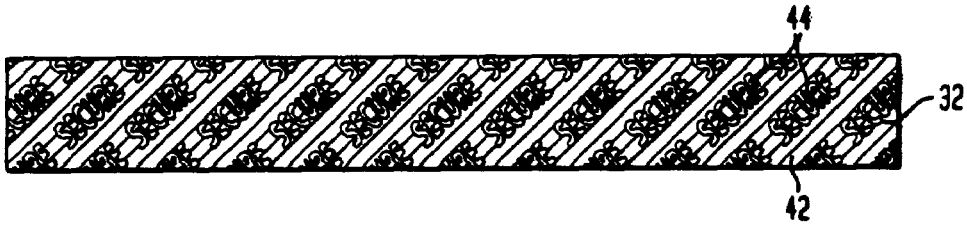
Figure 5D:
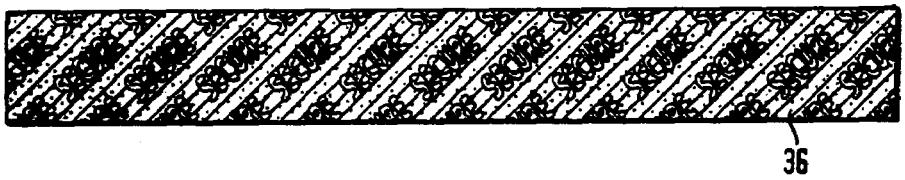
Figure 6:
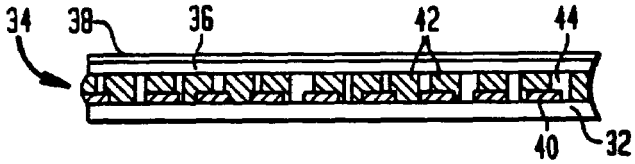
FIG. 6 is a schematic cross-sectional view of the tape of FIG. 5D.

Strip 32, shown in FIG. 5A, preferably is formed from a tough plastic material so as to support the various layers deposited thereon and resist significant stretching and tearing as seal 28 is opened. Furthermore, the material for forming strip 32 preferably is transparent, partially transparent or translucent so that any evidence of tampering with seal 28 can easily be seen. By making strip 32 partially transparent or translucent, objects that are in direct contact with the inner surface of strip 32 may be seen from the outer side of the strip. On the other hand, it will not be possible to see objects clearly, if at all, if they are positioned near the inner surface of strip 32, but not in direct contact therewith. Accordingly, ink layer 34 printed on the inner surface of strip 32 will be clearly visible from the outer surface of the strip. However, any of ink layer 34 which delaminates from strip 32 as seal 28 is opened will be difficult to see clearly from the outer side of the strip. A particularly preferred material for forming strip 32 is a partially transparent or translucent high-density polyethylene.

As noted above, one surface of strip 32 is coated with an ink layer 34. Ink layer 34 actually consists of multiple components. A first component consists of a patterned layer of a release material 40 printed on the surface of strip 32, such as through a flexographic printing process. The release material 40 should bond weakly to strip 32 so as to be easily separated therefrom. Alternatively, release material 40 should bond weakly to the overlying layer of colored ink described below so as to separate from the ink while remaining adhered to strip 32. Release material 40 is preferably clear or almost clear so that the pattern in which the release material is printed on strip 32 will not be visible in the completed tape 30, and so that the release material will not interfere with the visibility of the other components of ink layer 34 through strip 32. Any known release material may be used, including a clear ink or ink extender, a UV-curable varnish and the like. A clear ink having a silicone base exhibits desirable release properties and is compatible with the other components of ink layer 34.

Release material 40 is preferably printed in a repeating pattern distributed uniformly across the entire surface of strip 32. Such distribution will cause the pattern to be revealed, regardless of whether only isolated portions of seal 28 are tampered with. As shown in the preferred embodiment of FIG. 5B, release material 40 may be printed as a repeating pattern of the word "void," although any pattern of words, symbols or other indicia may be used.

After release material 40 has been applied and dried, a layer of a colored ink 42 is applied in a substantially uniform thickness to strip 32. The colored ink is preferably opaque and water-based, although the use of solvent-based inks is also contemplated herein. Colored ink layer 42 is applied so as to deliberately include void spaces 44 which are free of colored ink. This may be accomplished, for example, by engraving the desired pattern in the print roller used in a flexographic printing process or in the printing plates used in a rotogravure printing process. Void spaces 44 preferably are formed in a repeating pattern distributed substantially uniformly throughout the entire surface of strip 32. In the preferred embodiment shown in FIG. 5C, void spaces 44 define a repeating pattern of the word "secure" along the surface of strip 32. It will be appreciated, however, that void spaces 44 may be in any pattern of words, symbols or other indicia. Because release material 40 is clear or almost clear, ink layer 42 will appear through strip 32 as a solid layer interrupted only by the pattern of void spaces 44.

Desirably, the repeating pattern of void spaces 44 will differ from the repeating pattern of release material 40. Moreover, the pattern of void spaces 44 preferably is out of registry with the pattern of release material 40. That is, in a preferred arrangement, the distance between adjacent void spaces 44 is different from the distance between adjacent deposits of release material 40 so that the void spaces overlap the release material by different amounts along the length of strip 32. Thus, at some locations on the strip the pattern of void spaces 44 may be substantially directly aligned over the pattern of release material 40, while at other locations on the strip the pattern of void spaces 44 do not overlap at all with the pattern of release material 40. Various degrees of overlap exist at locations intermediate these extremes. It will be appreciated that, even where void spaces 44 overlap with deposits of release material 40, the release material will not be seen through strip 32 in the manufactured state of tape 30.

After the components of ink layer 34 have been applied to strip 32, adhesive layer 36 is applied over ink layer 34. Adhesive layer 36 may be formed from any adhesive material which will strongly adhere both to ink layer 34 and to the rear wall 14 of bag 10 upon closure of seal 28, thereby making it difficult to open the bag without distorting the seal or other parts of the bag. Preferred adhesives in this regard are high tack adhesives. As used herein, high tack adhesives are highly sticky pressure sensitive adhesives giving high initial adhesion under normal application pressure. Hot melt pressure sensitive adhesives are particularly preferred.

The peel-back strip 38 covers adhesive layer 36 and prevents the adhesive from prematurely adhering to rear wall 14, to other parts of bag 10, or to currency, papers or other articles as they are inserted into bag 10 through opening 16. Peel-back strip 38 may be formed from any material having sufficient strength to maintain its integrity as it is removed from adhesive layer 36. One such material for forming peel-back strip 38 is a polyester film.

As noted above, tape 30 is secured along its bottom edge to the outer surface of front wall 12 adjacent the free end 26 of the wall. This connection may be made by exposing a region of adhesive layer 36 and pressing tape 30 to front wall 12 in this region. Alternatively, tape 30 may be joined to front wall 12 by heat welding, ultrasonic welding or other known joining techniques.

The use of bag 10 to transport and/or store valuables will now be described. After the valuables have been inserted into bag 10 through opening 16, the opening may be sealed by removing peel-back strip 38 from adhesive layer 36 and pressing tape 30 against the upper end of rear wall 14. In this sealed condition, ink layer 34 and adhesive layer 36 are sandwiched between plastic strip 32 and rear wall 14.

Figure 2:
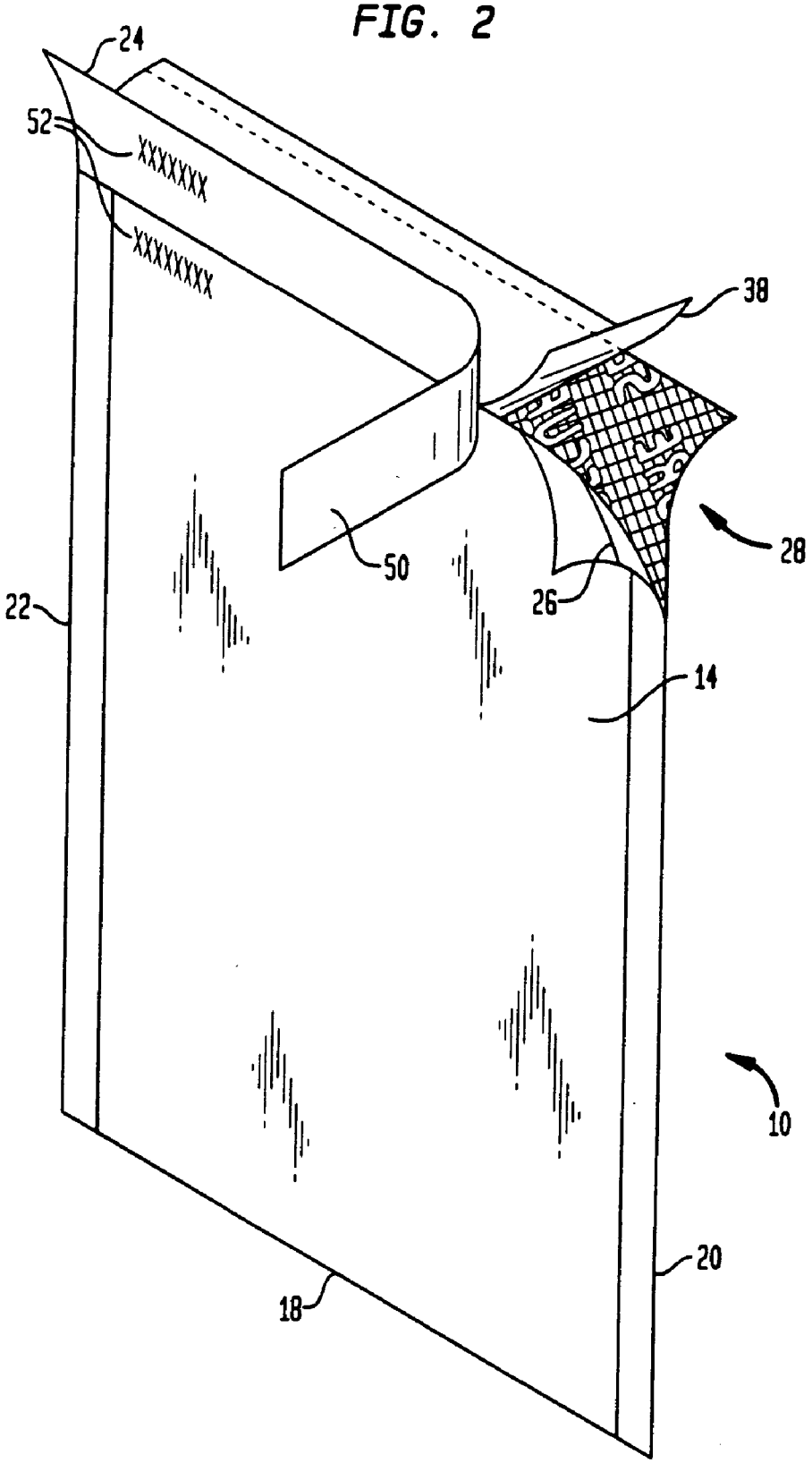
FIG. 2 is a rear perspective view of the tamper-evident security bag of FIG. 1.
Figure 3:
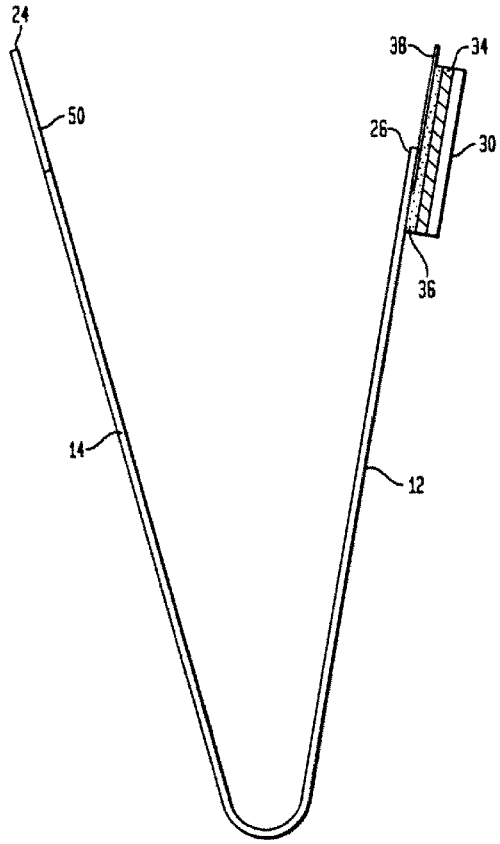
FIG. 3 is a cross-sectional view of the tamper-evident security bag of FIG. 1, showing the seal in an open condition.
Figure 4:
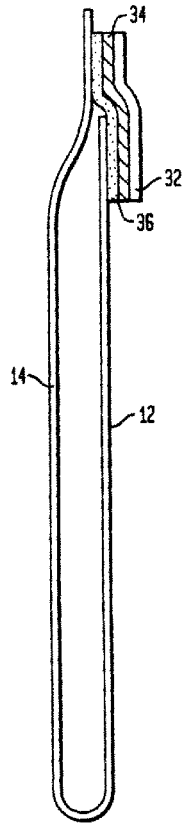
FIG. 4 is a cross-sectional view of the tamper-evident security bag of FIG. 1, showing the seal in a closed condition.

As shown in FIGS. 1 and 2, identification strip 50 may be formed by perforations extending across the width of rear wall 14 so that the identification strip can be easily removed therefrom. Matching identifying indicia 52 may be printed both on identification strip 50 and on the front wall 12 or rear wall 14 of the bag. Identification strip 50 may be removed from bag 10 either before or after the bag has been sealed closed.

Figure 7:
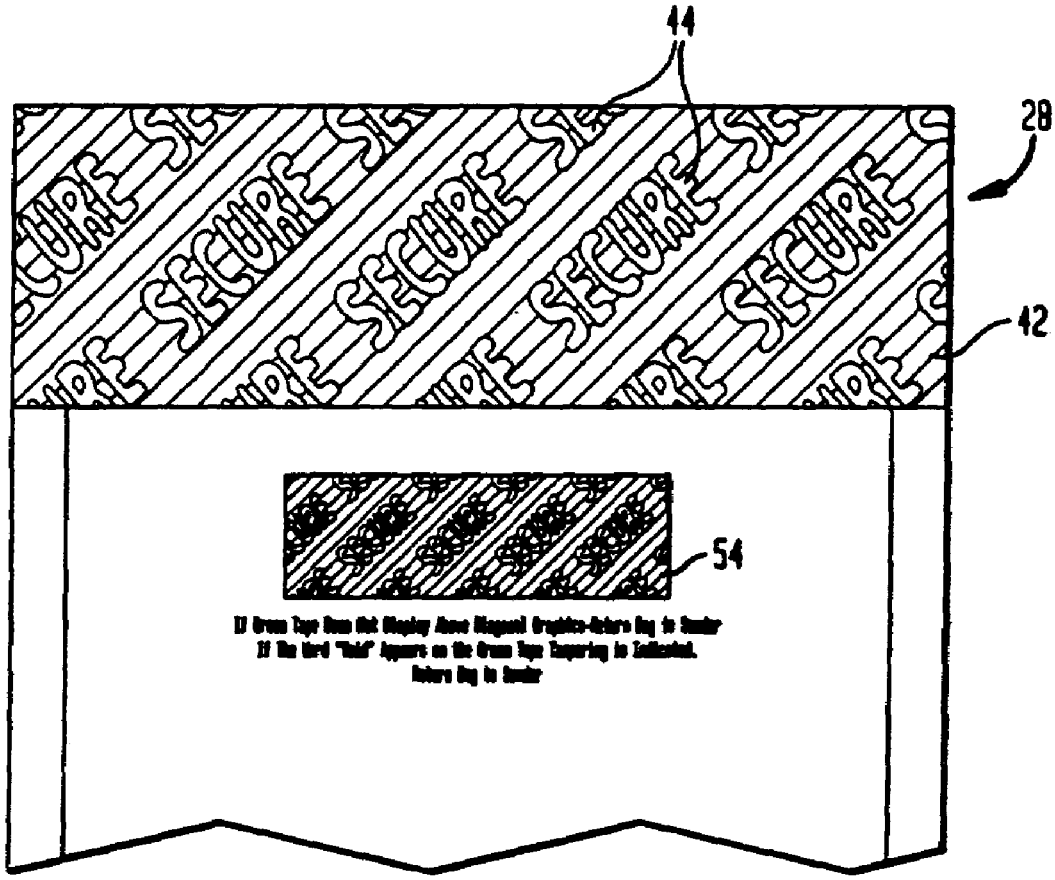
FIG. 7 is an enlarged, partial, front view of the tamper-evident security bag of FIG. 1 in an initial sealed condition.
Figure 8:
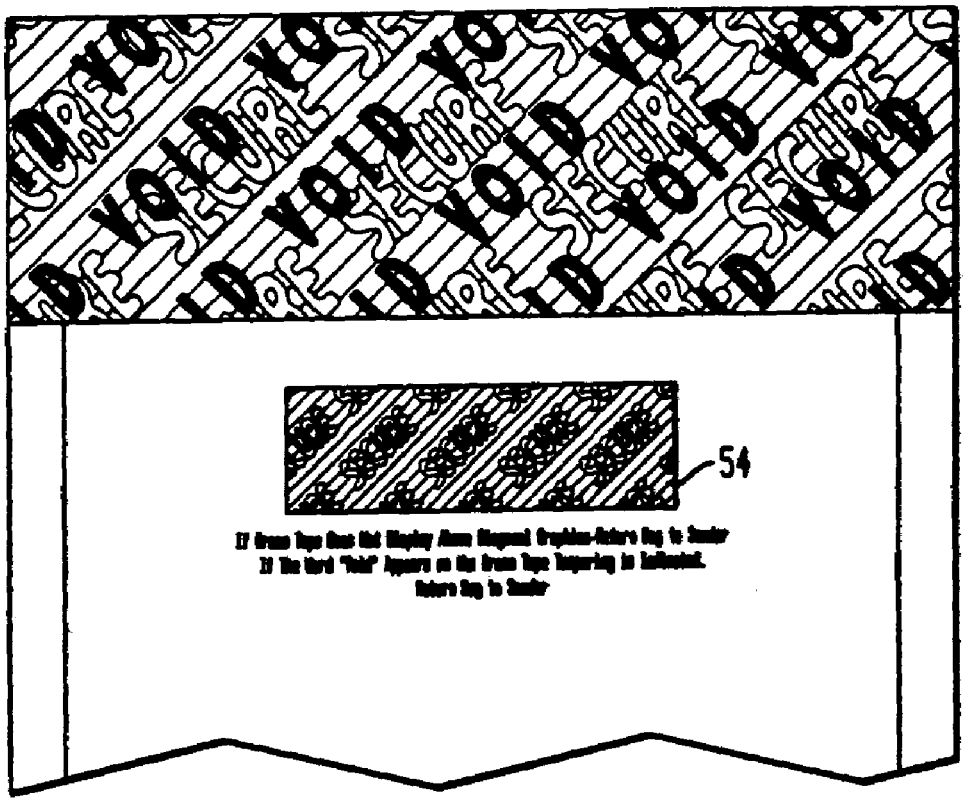
FIG. 8 is an enlarged, partial, front view of the tamper-evident security bag of FIG. 1 after it has been opened by tampering and resealed.

After bag 10 has been sealed closed, any attempts to open the bag will be apparent from a visual change in seal 28. This change in appearance can best be seen with reference to FIGS. 7 and 8. FIG. 7 shows the appearance of bag 10 after it has been sealed closed and before any attempt has been made to open seal 28. As can be seen, in this initial state, seal 28 appears as a colored layer having a pattern of void spaces 44 distributed substantially uniformly throughout. In fact, the appearance of seal 28 matches the appearance of a graphic 54 preprinted on bag 10 just below the seal. When the appearance of seal 28 matches the appearance of preprinted graphic 54, the user knows that seal 28 has not been opened.

If seal 28 is forced open, the portion of ink layer 42 overlying the deposits of release material 40 will delaminate from strip 32 and remain adhered to adhesive layer 36. When this occurs, the ink in the delaminated regions will no longer be visible through strip 32 such that the repeating pattern of the word "void" will appear. Even when seal 28 is reclosed after tampering, the ink in the delaminated regions will have a different appearance than the ink that did not delaminate from strip 32, such that the word "void" will still appear in a repeating pattern. Because the repeating pattern of the word "void" is not in registry with the repeating pattern of void spaces 44, the words "void" will overlap in varying degrees with the void spaces, all of which can be seen in FIG. 8. This varying degree of overlap will make it difficult for thieves to conceal the opening of seal 28. More particularly, any attempt to fill the words "void" with a quick-drying ink marker will also at least partially fill in void spaces 44, such that seal 28 of a bag which has been tampered with will not match the appearance of preprinted graphic 54. Thus, seal 28 will quickly and reliably evidence any unauthorized opening of bag 10. Furthermore, since void spaces 44 repeat at a different rate than the deposits of release material 40, the degree of overlap between void spaces 44 and release material 40 will be arbitrary, and therefore are likely to be different from bag to bag. As a result, it will be difficult, if not impossible, for thieves to create a template which would enable them to quickly and completely fill the words "void" with an ink marker or other coloring technique without filling in any of void spaces 44.

To assure that only the portions of ink layer 42 overlying release material 40 delaminate from strip 32 when seal 28 is forced open, it is necessary for ink layer 42 to have a greater adhesion to adhesive layer 36 than to release material 40, and at the same time, to bond more weakly to adhesive layer 36 than to strip 32. In addition to the use of release material 40, the relative adhesion to strip 32, front wall 12 and/or rear wall 14 can be altered to varying degrees by treating these layers, such as with a corona discharge, applying a surface modifier, etc.

It will be appreciated that various modifications may be made to bag 10 in accordance with the present invention. For example, rather than applying adhesive layer 36 over ink layer 34 on tape 30, adhesive layer may be applied to the inner surface of rear wall 14 in the region just below identification strip 50. Peel-back strip 38 would be applied over adhesive layer 36 on rear wall 14, and would be removed to secure rear wall 14 to tape 30.

In another variant hereof, strip 32 may be eliminated, and the various other layers of tape 30 may be applied directly to the inner surface of either front wall 12 or rear wall 14. For example, the layer of release material 40 may be printed directly on either wall of the bag, followed by ink layer 42. Adhesive layer 36 and peel-back strip 38 may then be applied either over ink layer 42 or to the other wall of bag 10 in opposed relationship to ink layer 42. In such embodiments, bag 10, or at least the portion of front wall 12 or rear wall 14 to which ink layer 34 is applied, should be at least partially transparent so that ink layer 34 will still be visible after the bag has been sealed closed.

In yet another variant, front wall 12 of bag 10, inclusive of tape 30, could have a length which is longer than the length of rear wall 14 after identification strip 50 has been removed. Bag 10 may then be sealed closed by folding seal 28 over the free end of rear wall 14 and adhering adhesive layer 36 to the outer surface of the rear wall.

Still further modifications relate to the relationship between the pattern in which release material 40 is deposited and the pattern of void spaces 44. Although it is preferred that these patterns be different, the patterns may be the same and simply out of registry with one another. Even where the patterns are the same, if they are out of registry, seal 28 after tampering will not match the appearance of preprinted graphic 54. For example, seal 28 after tampering may display the same word, symbol or other indicia as depicted in preprinted graphic 54 (which results from void spaces 44), but these indicia may appear in different positions than in the preprinted graphic. Alternatively, the words, symbols or other indicia formed by release material 40 may be different from the indicia formed by void spaces 44, but may be deposited in the same locations as void spaces 44 so that the indicia at least partially overlap. In either event, forcing seal 28 open will cause the seal to have a different appearance than that of preprinted graphic 54.

It also will be appreciated that tape 30 need not be a component of a tamper-evident security bag, but may be used alone as a tamper-evident seal for conventional boxes, bags and other containers. In such event, tape 30 would be applied to a container as would a conventional tape to seal the container in a closed condition. When applied to the container, the pattern produced by void spaces 44 would be clearly evident, but the pattern produced by the release material 40 would not. Any attempt to open the container by removing tape 30 would cause the pattern produced by release material 40 to be revealed in varying degrees of overlap with the pattern created by void spaces 44, thus evidencing the unauthorized opening or attempted opening of the container.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A tamper-indicating bag, comprising:

first and second walls joined together along spaced joining lines to form an enclosure having an open end;

a tamper-evident indicator extending in a longitudinal direction, the tamper-evident indicator including a backing layer joined to said first wall at said open end of said enclosure, a layer of a release material disposed in a predetermined pattern on said backing layer so as to define first regions in which said release material is present and second regions in which said release material is not present, adjacent ones of said first regions being spaced apart by a first distance in said longitudinal direction, and a layer of ink disposed over said release material layer, said ink layer including a plurality of spaces devoid of ink arranged in a selected pattern, adjacent ones of said plurality of spaces being spaced apart in said longitudinal direction by a second distance different from said first distance, said selected pattern being out of registry with said predetermined pattern of said release material so as to define regions in which said ink overlies said release material and regions in which said ink does not overlie said release material;

a layer of adhesive adapted to secure said indicator to said second wall in a sealed condition of said enclosure so that said ink layer is disposed between said backing layer and said adhesive layer;

said ink layer having a greater adhesion to said second wall than to said backing layer in regions overlying said release material, and having a lower adhesion to said second wall than to said backing layer in regions not overlying said release material so that, upon separation of said backing layer from said second wall, portions of said ink layer will separate from said backing layer while a remainder of said ink layer will not separate from said backing layer, whereby said predetermined pattern will be visible in said indicator.

2. The tamper-indicating bag as claimed in claim 1, wherein said backing layer is at least partially transparent in a region overlapping with said ink layer in said sealed condition of said enclosure.

3. The tamper-indicating bag as claimed in claim 1, wherein said predetermined pattern of said release material is different from said selected pattern of said plurality of spaces devoid of ink.

4. The tamper-indicating bag as claimed in claim 1, wherein said tamper-evident indicator has a first visual appearance in an initial sealed condition of said enclosure, and has a visual appearance upon separation of said backing layer from said second wall which is different from said first visual appearance.

5. The tamper-indicating bag as claimed in claim 4, further comprising a preprinted graphic on one of said first and second walls, said preprinted graphic having an appearance which is the same as said first visual appearance of said tamper-evident indicator.

6. The tamper-indicating bag as claimed in claim 1, wherein said predetermined pattern of said release material at least partially overlaps with said selected pattern of said plurality of spaces devoid of ink.

7. A tamper-indicating bag, comprising:

first and second walls joined together along spaced joining lines to form an enclosure having an open end;

a tape secured to said first wall, said tape being spaced from said second wall in an open condition of said enclosure and being secured to said second wall in a sealed condition of said enclosure;

said tape including an elongated flexible strip extending in a longitudinal direction, a layer of a release material disposed in a predetermined pattern on said strip so as to define first regions in which said release material is present and second regions in which said release material is not present, adjacent ones of said first regions being spaced apart by a first distance in said longitudinal direction, and a layer of ink disposed on said strip over said release material layer, said ink layer including a plurality of spaces devoid of ink arranged in a selected pattern, adjacent ones of said plurality of spaces being spaced apart in said longitudinal direction by a second distance different from said first distance, said selected pattern being out of registry with said predetermined pattern of said release material so as to define regions in which said ink overlies said release material and regions of in which said ink does not overlie said release material;

a layer of adhesive adapted to secure said tape to said second wall in said sealed condition of said enclosure so that said ink layer is disposed between said strip and said adhesive layer;

said ink layer having a greater adhesion to said second wall than to said strip in regions overlying said release material, and having a lower adhesion to said second wall than to said strip in regions not overlying said release material so that, upon separation of said strip from said second wall, portions of said ink layer will separate from said strip while a remainder of said ink layer will not separate from said strip, whereby said predetermined pattern will be visible in said tape.

8. The tamper-indicating bag as claimed in claim 7, wherein said strip is at least partially transparent.

9. The tamper-indicating bag as claimed in claim 7, wherein said predetermined pattern of said release material is different from said selected pattern of said plurality of spaces devoid of ink.

10. The tamper-indicating bag as claimed in claim 7, wherein said tape has a first visual appearance in an initial sealed condition of said enclosure, and has a visual appearance upon separation of said tape from said second wall which is different from said first visual appearance.

11. The tamper-indicating bag as claimed in claim 10, further comprising a preprinted graphic on one of said first and second walls, said preprinted graphic having an appearance which is the same as said first visual appearance of said tape.

12. The tamper-indicating bag as claimed in claim 7, wherein said predetermined pattern of said release material at least partially overlaps with said selected pattern of said plurality of spaces devoid of ink.

13. A tamper-indicating tape for providing a closure seal for a container, said tape comprising:

an elongate, flexible strip extending in a longitudinal direction and having first and second sides;

a layer of a release material disposed in a predetermined pattern on said first side of said strip so as to define first regions in which said release material is present and second regions in which said release material is not present, adjacent ones of said first regions being spaced apart by a first distance in said longitudinal direction;

a layer of ink disposed on said first side of said strip over said release material layer, said ink layer including a plurality of spaces devoid of ink arranged in a selected pattern, adjacent ones of said plurality of spaces being spaced apart in said longitudinal direction by a second distance different from said first distance, said selected pattern being out of registry with said predetermined pattern of said release material so as to define regions in which said ink overlies said release material and regions in which said ink does not overlie said release material; and a layer of adhesive disposed over said ink layer;

said ink layer having a greater adhesion to said adhesive layer than to said strip in regions overlying said release material, and having a lower adhesion to said adhesive layer than to said strip in regions not overlying said release material so that, upon separation of said tape from the container, portions of said ink layer will separate from said strip while a remainder of said ink layer will not separate from said strip, whereby said predetermined pattern will be visible in said tape.

14. The tamper-indicating tape as claimed in claim 13, wherein said strip is at least partially transparent.

15. The tamper-indicating tape as claimed in claim 13, wherein said predetermined pattern of said release material is different from said selected pattern of said plurality of spaces devoid of ink.

16. The tamper-indicating tape as claimed in claim 13, wherein said tape has a first visual appearance as initially applied to the container, and has a visual appearance upon separation of said tape from the container which is different from said first visual appearance.

17. The tamper-indicating tape as claimed in claim 13, wherein said predetermined pattern of said release material at least partially overlaps with said selected pattern of said plurality of spaces devoid of ink.

* * * * *

UNITED STATES PATENT AND TRADEMARK OFFICE

CERTIFICATE OF CORRECTION

PATENT NO. : 7,223,015 B2
APPLICATION NO. : 10/603345
DATED : May 29, 2007
INVENTOR(S) : Jeffrey E. Steffens It is certified that error appears in the above-identified patent and that said Letters Patent is hereby corrected as shown below:

Column 9, line 33, delete "of" after "regions."

Signed and Sealed this

Twenty-ninth Day of April, 2008

JON W. DUDAS
*Director of the United States Patent and Trademark Office*